US006874293B2

(12) United States Patent
Manthei

(10) Patent No.: US 6,874,293 B2
(45) Date of Patent: Apr. 5, 2005

(54) PROTRUDING PLANTER BLOCK FOR RETAINING WALL

(75) Inventor: James A. Manthei, Petoskey, MI (US)

(73) Assignee: Redi-Rock International, LLC, Charlevoix, MI (US)

( * ) Notice: Subject to any disclaimer, the term of this patent is extended or adjusted under 35 U.S.C. 154(b) by 41 days.

(21) Appl. No.: 10/390,049

(22) Filed: Mar. 17, 2003

(65) Prior Publication Data

US 2004/0182038 A1 Sep. 23, 2004

(51) Int. Cl.[7] ..... E04C 2/04

(52) U.S. Cl. ..... 52/596; 52/608; 47/82; 47/83

(58) Field of Search ..... 52/169.4, 439, 52/596, 608; 47/82, 83, 33, 47; 405/15, 16, 21, 23, 25, 110, 114, 262, 284, 285, 286

(56) References Cited

U.S. PATENT DOCUMENTS 2,960,797 A * 11/1960 Frehner ..... 47/33
4,278,364 A * 7/1981 Frehner ..... 405/273
4,521,138 A * 6/1985 Steiner ..... 405/284
4,524,551 A 6/1985 Scheiwiller ..... 52/98
4,655,016 A * 4/1987 Jacob ..... 52/169.1
4,671,706 A * 6/1987 Giardini ..... 405/286
4,964,761 A * 10/1990 Rossi ..... 405/286
5,419,092 A 5/1995 Jaecklin ..... 52/562
5,456,555 A * 10/1995 Bokeler ..... 405/286
5,601,384 A * 2/1997 Dawson ..... 405/284
5,678,958 A * 10/1997 Rossi ..... 405/286
6,287,054 B1 * 9/2001 Egan et al. ..... 405/262
6,371,700 B1 4/2002 Rich ..... 405/284
6,715,965 B2 * 4/2004 Manthei et al. ..... 405/284

* cited by examiner

*Primary Examiner*—Carl D. Friedman
*Assistant Examiner*—Nahid Amiri
(74) *Attorney, Agent, or Firm*—MacMillan, Sobanski & Todd, LLC

(57) ABSTRACT

A cast concrete block for use in a vertical retaining wall. The block has a generally vertical front face which is visible when the block is stacked in a retaining wall. A pocket is formed in the block to project from a portion of the visible face of the block. The pocket has an upwardly directed opening which is exposed for receiving soil and plants when the block is located in a vertical retaining wall. The opening may extend through the block to a rear of the block.

8 Claims, 4 Drawing Sheets

PROTRUDING PLANTER BLOCK FOR RETAINING WALL

CROSS-REFERENCE TO RELATED APPLICATIONS

Not Applicable.

STATEMENT REGARDING FEDERALLY SPONSORED RESEARCH OR DEVELOPMENT

Not Applicable.

TECHNICAL FIELD

The invention relates to retaining walls and more particularly to a planter block for a retaining wall constructed from stacked concrete blocks.

BACKGROUND OF THE INVENTION

Concrete blocks are frequently used for constructing retaining walls. Rectangular blocks have been stacked to form a retaining wall and then back filled on one side to form a terrace. The backfill can exert a sufficient force on the retaining wall blocks to cause the stacked blocks to move out of their original position. In some cases, the blocks are stacked to form a stepped wall so that the front face of each row or tier of blocks is offset slightly behind the front face of the adjacent lower tier of blocks. Further, a raised lip has sometimes been formed along the upper edge of the block adjacent the front face to prevent the stepped blocks from sliding out of position, as shown in Arvai et al. U.S. Pat. No. 5,791,827.

In order to increase stability, retaining wall blocks have sometimes been formed with a groove extending along a bottom surface parallel to an exposed face of the block and a raised portion is formed on a top surface to extend parallel to the front face. The groove on a stacked block receives the raised portion on an adjacent lower block for maintaining alignment of the front faces of the stacked blocks. Such an arrangement is shown, for example, in Forlini U.S. Pat. No. 5,647,185. Retaining wall blocks also may be formed with round knobs on the top surface which fit into a groove on the bottom surface of a stacked block to permit forming a curved retaining wall, as shown in Wagenaar U.S. Pat. No. 5,337,527. Another method for stabilizing a retaining wall constructed from concrete blocks is through the use of a geogrid tie back system in which the retaining wall is secured to the ground behind the retaining wall with various types of ground anchors. The use of ground anchors for stabilizing retaining walls is shown, for example, in Kelly, Jr. U.S. Pat. No. 5,402,609 and in Wagenaar U.S. Pat. No. 5,337,517.

For aesthetic purposes, it is sometimes desirable to design a retaining wall to include recesses filled with earth in which flowers, vines or other plants are planted. In the past, this has been accomplished by forming a step between two tiers of blocks in the wall. A groove is formed in the top of a lower tier of blocks adjacent the exposed face of the blocks. The groove is then filled with earth and vegetation. The next tier of blocks in the wall is stepped back to at least partially expose the groove, as shown, for example, in U.S. Pat. No. 6,371,700. However, retaining walls with prior art planter blocks were not vertical due to the step required to expose the recess for the plants.

BRIEF SUMMARY OF THE INVENTION

The invention is directed to a planter block for a concrete block retaining wall. The planter block provides at least one pocket which protrudes outwardly from a portion of a front face of the block for filling with soil and plants. The pocket does not interfere with construction of a vertical retaining wall since it does not require offsetting tiers of blocks for providing space for plants. The front face of the planter block is generally rectangular with upper and lower edges. Preferably, the pocket protrudes outwardly from a center region of the upper edge of the block face and angles downwardly towards the lower edge of the block face. An opening or recess is formed in the pocket and, preferably, in a portion of the top of the block to extend into the pocket. The recess is filled with soil suitable for growing plants. Preferably, the recess extends to the rear of the block to provide drainage of any excess water which may enter the pocket.

Accordingly, it is an object of the invention to provide a protruding planter block for concrete block retaining walls.

Other objects and advantages of the invention will become apparent from the following detailed description of the invention and the accompanying drawings.

DETAILED DESCRIPTION OF THE INVENTION

Figure 1:
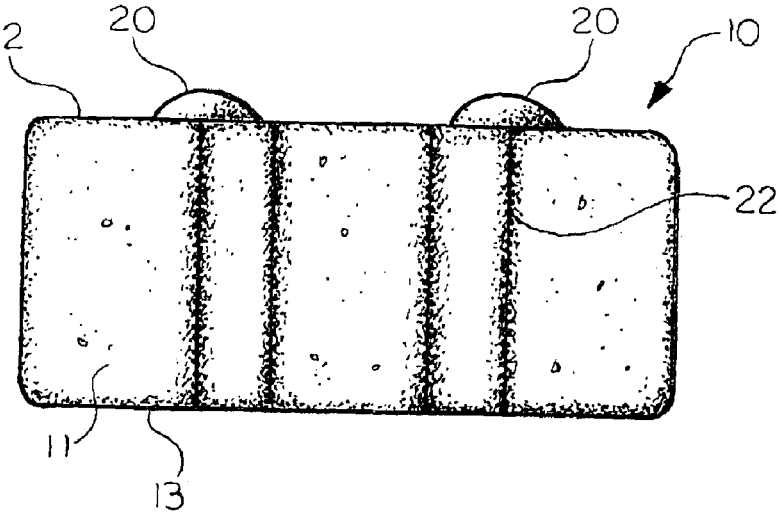
FIG. 1 is a front elevational view of a concrete planter block according to the invention.
Figure 2:
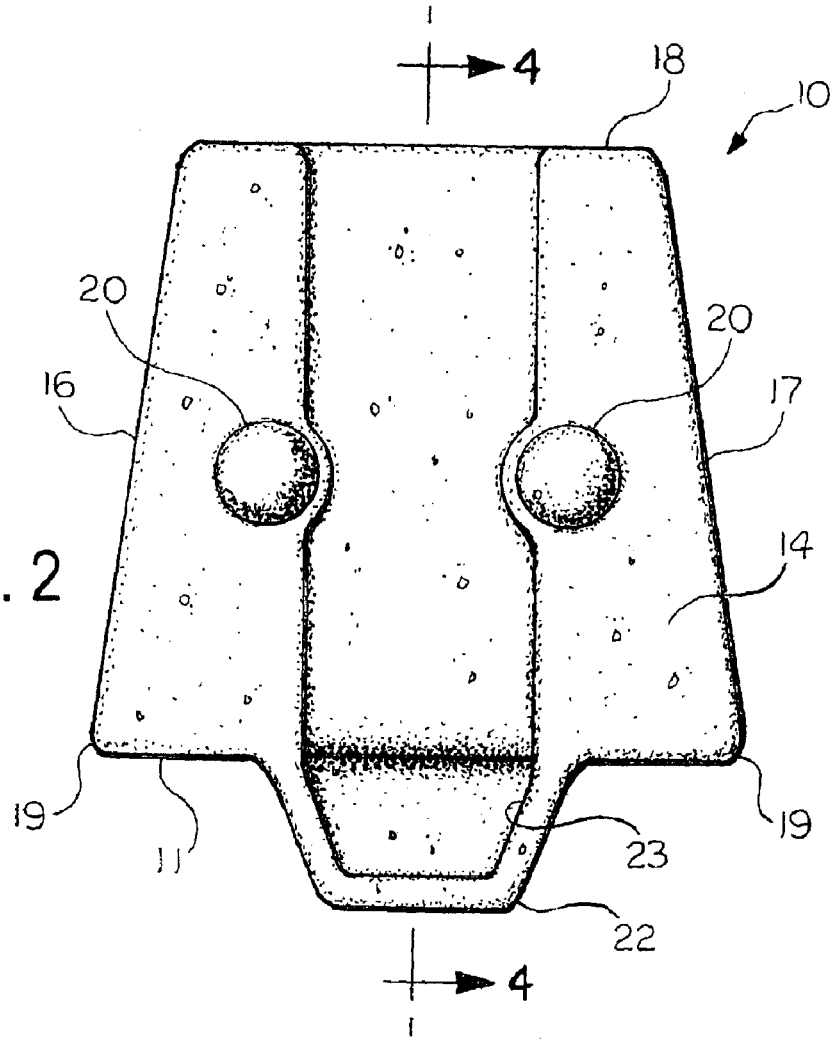
FIG. 2 is a top plan view of the concrete planter block of FIG. 1.
Figure 3:
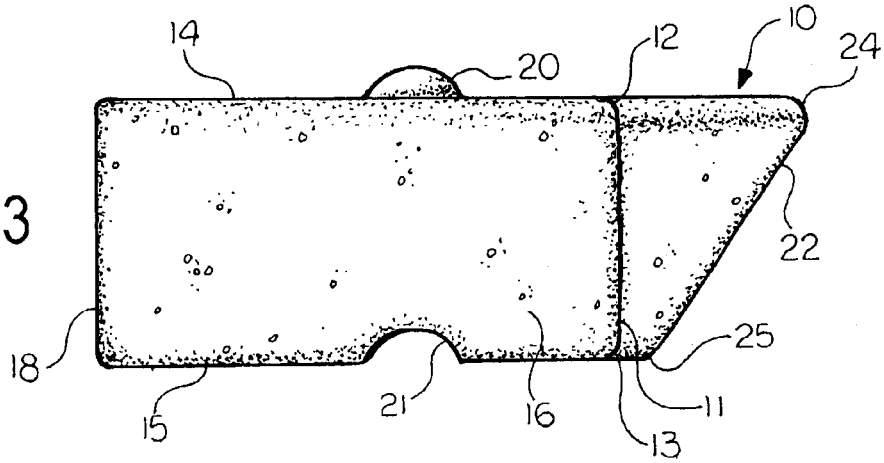
FIG. 3 is a left side elevational view of the planter block of FIG. 1.
Figure 4:
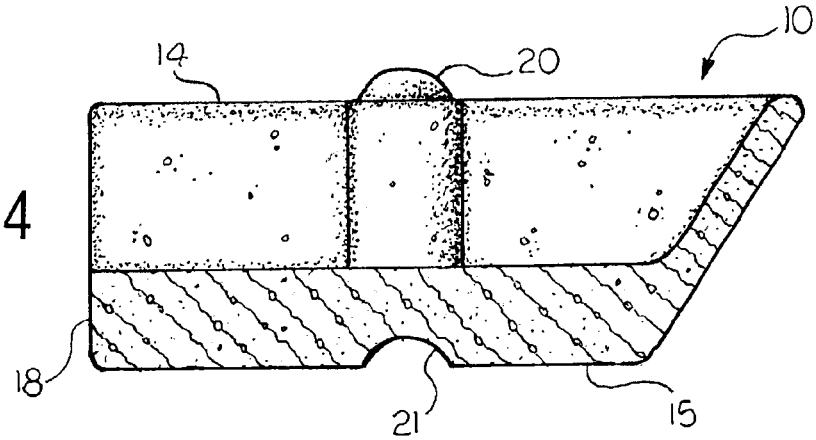
FIG. 4 is a cross sectional view as taken along line 4—4 of FIG. 2.
Figure 5:
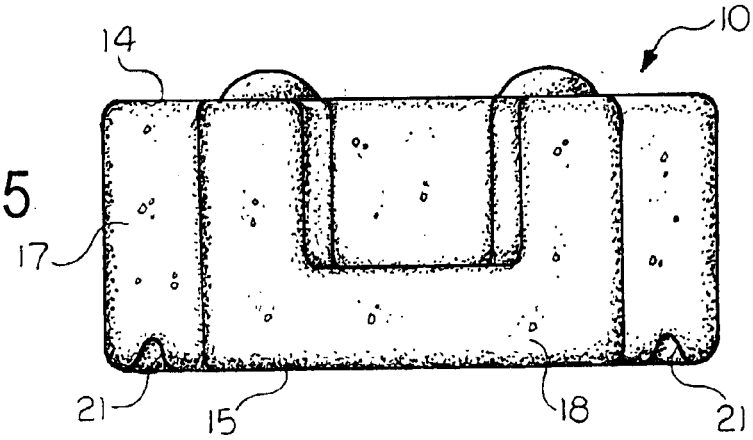
FIG. 5 is a rear elevational view of the planter block of FIG. 1.

Referring to FIGS. 1–5, a precast concrete retaining wall block 10 is shown according to a preferred embodiment of the invention. The block 10 has a generally rectangular vertical front face 11. The face 11 has upper and lower edges, 12 and 13. The block 10 also has a top 14, a bottom 15, a left side 16, a right side 17 and a rear 18. When viewed in plan, the top 14 is preferably trapezoidal, with the front fact 11 wider than the rear side 18. This allows blocks 10 to be placed in a row or tier with edges 19 of adjacent blocks abutting with the faces 11 of adjacent blocks to be either aligned or angled to form either straight or curved walls. However, it also should be appreciated that the block 10 may be generally rectangular in plan for stacking to form a straight retaining wall without departing from the invention.

It is intended that a retaining wall constructed from the blocks 10 will have at least two tiers of blocks 10 for at least a portion of the wall. Preferably, a known block design is used to prevent the blocks in the upper tier from being pushed out of alignment with the blocks in the adjacent lower tier. One known block design involves providing one or more projections on the top 14 of the block 10 in the lower tier, such as the two illustrated semi-spherical projections 20. A complementary groove 21 is formed in the bottom 15 of the adjacent block 10 in the adjacent upper tier. When the upper tier blocks 10 are stacked on an adjacent lower tier of blocks 10, the grooves 21 on the upper blocks are positioned to receive the adjacent projections 20 on the lower blocks. So long as the projections 20 and the grooves 21 have the same spacing from the front face 11, the front faces 11 of the stacked blocks will be vertically aligned. If a stepped wall is desired, the knobs 20 will be located further back from the front face 11 than the bottom grooves 21. It should be appreciated that different shaped projections may be placed on either the top or the bottom of the blocks and a groove or recess shaped to receive the projections is formed on the other of the bottom or the top of the blocks without departing from the invention. A wall constructed from the blocks 10 also may be stabilized with a known geogrid system.

According to the invention, at least one pocket 22 projects outwardly from a portion of the vertical front face 11. Preferably, a single pocket 22 is located in the central region of the face 11. The pocket 22 has an upwardly directed opening 23 which extends outwardly past the face 11. The opening 23 may extend to the rear side 18, as shown, to drain any excess water from the opening 23. The pocket opening 23 is adapted to receive soil and the portion of the opening 23 which extends outwardly past the face 11 is adapted to receive flowers, vines such as ivy or other plants. In the illustrated block 10, the pocket 22 has an upper edge 24 which is spaced from the upper edge 12 of the face 11 to provide a desired size opening 23. The illustrated pocket angles from the upper edge 24 towards the lower face edge 13 to a lower edge 25, which may be coincident with or spaced from the lower face edge 13. Although the pocket 22 is shown as being generally rectangular when viewed from the front and as being tapered when viewed from the side, it will be appreciated that the pocket 22 may have other ornamental configurations so long as it has an upwardly directed opening 23 and extends outwardly from the vertical block face 11. For example, the pocket 22 may be bulbous or semispherical in shape with an open top for receiving soil and plants.

Figure 6:
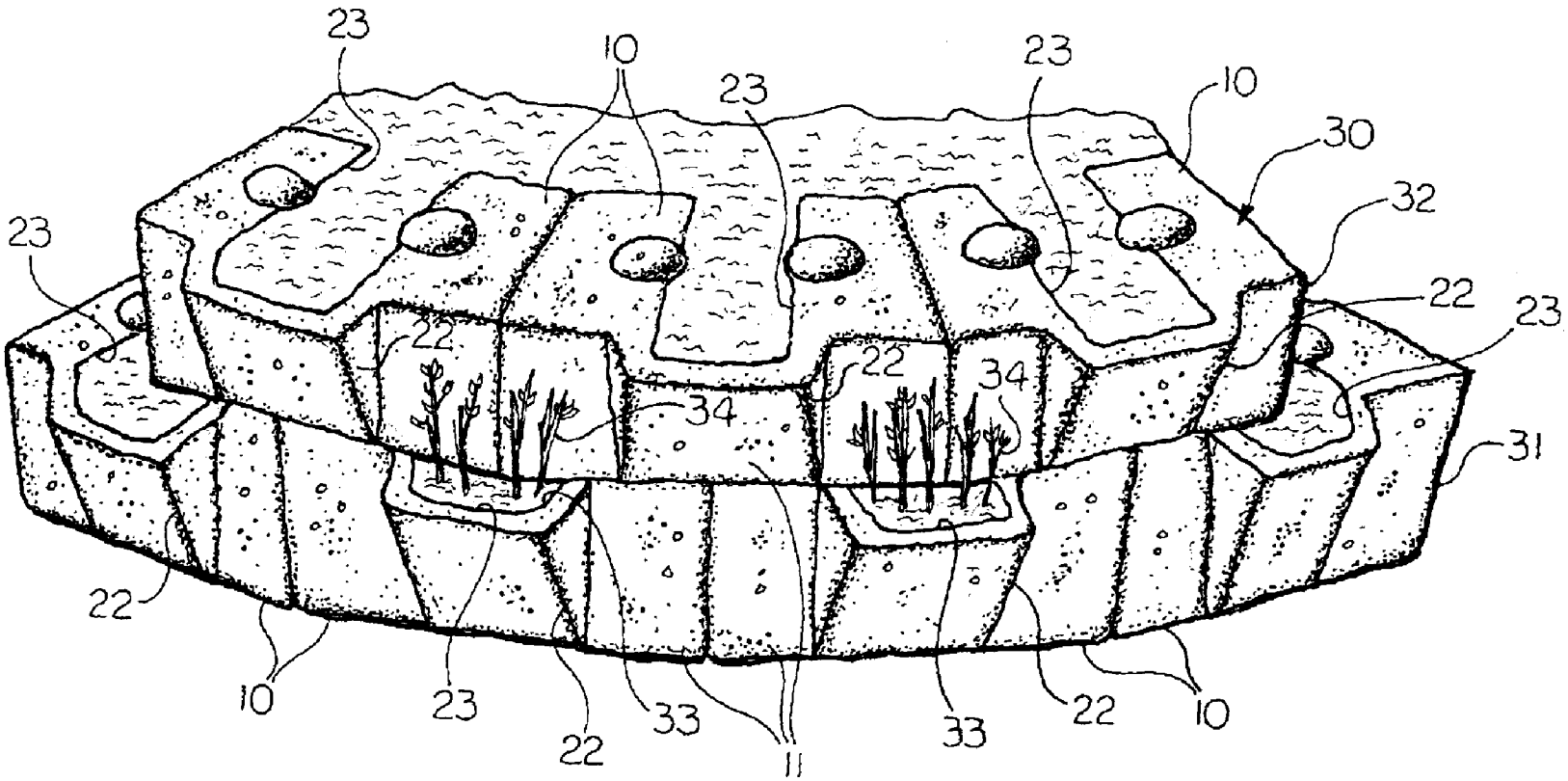
FIG. 6 is a fragmentary perspective view of a two tier curved retaining wall constructed with concrete planter blocks according to the invention.

FIG. 6 is a fragmentary view of a vertical retaining wall 30 constructed with the blocks 10. The wall 30 is shown with a lower tier 31 of blocks 10 and an upper tier 32 of blocks 10. It will be appreciated that the wall 30 may have additional tiers of blocks, and that the wall 30 may be formed only with protruding planter blocks 10, or with a mix of blocks having a flat face 11 without the pocket 22 and of the blocks 10 with the pocket 22. As shown in FIG. 6, only a portion 33 of the opening 23 in blocks 10 in the lower tier 31 is exposed when blocks 10 in the upper tier 32 are placed over the lower tier blocks 10. The exposed portion 33 is of a suitable size for receiving plants 34, such as flowers, ivy or small shrubs. FIG. 6 also shows that the block faces 11 can be vertically aligned while leaving the protruding pockets 22 for plantings. This differs from prior art walls which required offsetting the blocks in an upper tier from the blocks in an adjacent lower tier in order to provide access to openings for plants.

Figure 7:
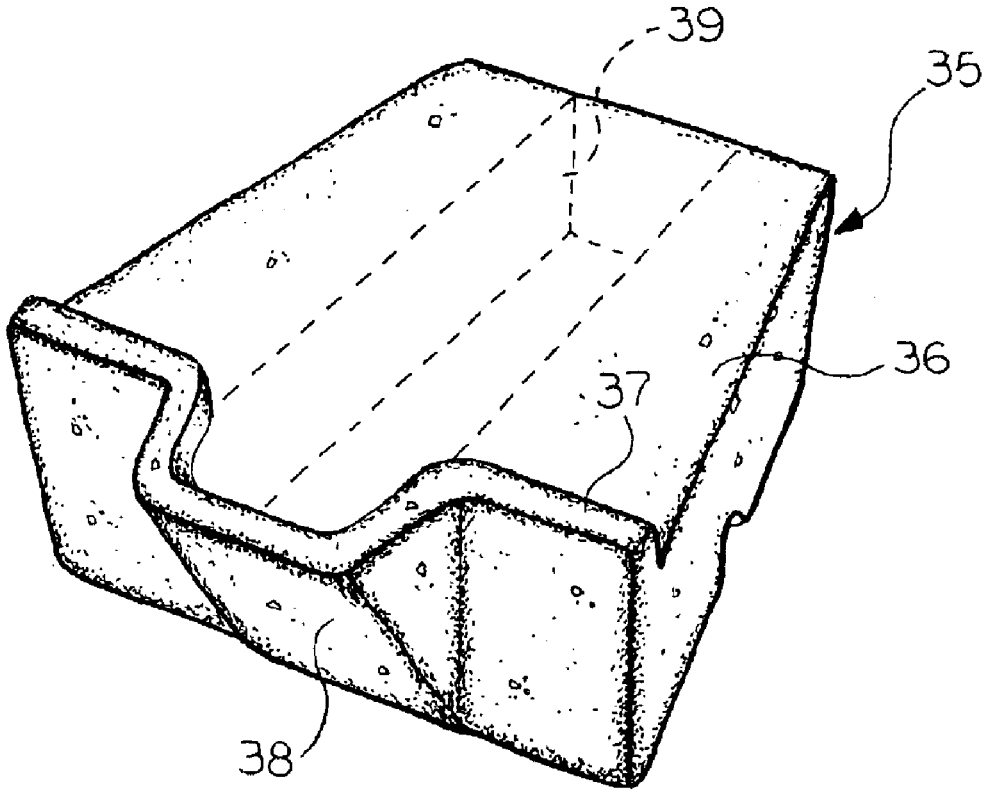
FIG. 7 is a perspective view of an optional modified block for the top tier of the retaining wall of FIG. 6.

Various modifications may be made to blocks for the uppermost tier on the retaining wall. FIG. 7 shows a top tier block 35 in which the knobs 20 are omitted and an upper surface 36 is recessed below a front edge 37. The recess of the upper surface 36 may be, for example, a few inches for allowing soil and grass to extend to the front edge 37, or it may be deeper for receiving larger plants or pavement. If desired, the block 35 may be provided with a protrusion 38 which either simulates or forms a pocket similar to the pocket 22, or the protrusion 38 may be omitted and the block 35 provided with a flat front face. The protrusion 38 also may connect with a trough 39 which extends to the rear of the block 35 to eliminate recesses in the block 35 which can trap water.

It will be appreciated that various modifications and changes may be made to the above described preferred embodiment of a planter block for retaining walls without departing from the scope of the following claims. For example, it will be appreciated that the shape of the pocket which protrudes from the front face of the block may be modified to provide other appearances and other sizes. The pocket may be more rounded, or it may be more boxy and its size may be varied to accommodate different types of plants.

What is claimed is:

1. A cast retaining wall planter block having a generally vertical front face which is visible when a plurality of said retaining wall block are stacked to form a vertical retaining wall, said retaining wall block having a pocket projecting outwardly from a portion of said front face, said pocket having an upwardly directed opening adapted to receive soil and plants when another retaining wall block is stacked vertically above said cast retaining wall block, wherein said front face has an upper edge and a lower edge, and wherein said pocket project further from said upper edge than from said lower edge.

2. A cast retaining wall planter block, as set forth in claim 1, and wherein said pocket projects outwardly from a central portion of said front face.

3. A cast retaining wall planter block, as set forth in claim 2, and wherein said pocket projects furthest from said front face adjacent said upper edge and tapers towards said lower edge.

4. A cast retaining wall planter block, as set forth in claim 1, and wherein said upwardly directed opening extends from said pocket to a rear face of said cast retaining wall planter block.

5. A vertical retaining wall constructed from a plurality of concrete blocks stacked in tiers, said blocks each having a substantially vertical visible front face, and wherein at least one of said blocks in a tier below the uppermost tier of blocks in the wall has a pocket projecting outwardly from a portion of said visible front face of said at least one block, said pocket having an exposed upwardly directed opening adapted to receive soil and plants wherein said visible front face of said at least one of said blocks has an upper edge and a lower edge, and wherein said pocket projects further from said upper edge than from said lower edge.

6. A vertical retaining wall, as set forth in claim 5, and wherein said pocket projects outwardly from a central portion of the visible front face of said at least one of said blocks.

7. A vertical retaining wall, as set forth in claim 6, and wherein said pocket projects furthest from the visible front face of said at least one of said blocks adjacent said upper edge and tapers generally towards said lower edge.

8. A vertical retaining wall, as set forth in claim 7, and wherein said upwardly directed opening extends from said pocket to a rear face of said at least one of said blocks.

* * * * *